US008227716B2

(12) United States Patent
Demleitner et al.

(10) Patent No.: US 8,227,716 B2
(45) Date of Patent: Jul. 24, 2012

(54) ACTUATOR

(75) Inventors: Johann Demleitner, Freudenberg (DE); Anja Voigt, Nürnberg (DE); Rudolf Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 228 days.

(21) Appl. No.: 12/680,252

(22) PCT Filed: Sep. 1, 2008

(86) PCT No.: PCT/EP2008/061511

§ 371 (c)(1), (2), (4) Date: Mar. 26, 2010

(87) PCT Pub. No.: WO2009/047050

PCT Pub. Date: Apr. 16, 2009

(65) Prior Publication Data

US 2010/0219054 A1 Sep. 2, 2010

(30) Foreign Application Priority Data

Oct. 1, 2007 (DE) ..... 10 2007 046 999

(51) Int. Cl.
*H01H 1/00* (2006.01)

(52) U.S. Cl. ..... 200/290

(58) Field of Classification Search ..... 200/290, 200/308, 340, 312, 520, 317; 116/279, 303, 116/321, 306, 286

See application file for complete search history.

(56) References Cited

U.S. PATENT DOCUMENTS

| | | | | |
|---|---|---|---|---|
| 3,508,519 | A | 4/1970 | Campbell | |
| 3,576,175 | A | 4/1971 | Gammill | |
| 3,769,482 | A * | 10/1973 | New et al. | 200/308 |
| 3,845,736 | A | 11/1974 | Golbeck | |
| 3,855,961 | A * | 12/1974 | Schadow | 116/279 |
| 4,031,849 | A * | 6/1977 | Mehta | 116/279 |
| 4,223,193 | A | 9/1980 | Iwasaki | |
| 4,287,401 | A | 9/1981 | Rohrbach | |
| 4,954,675 | A | 9/1990 | Iwata | |

* cited by examiner

*Primary Examiner* — Edwin A. Leon

(74) *Attorney, Agent, or Firm* — Harness, Dickey & Pierce, P.L.C.

(57) ABSTRACT

At least one embodiment of the invention relates to an actuator including a mechanical display, wherein the actuator is provided for switching a switch unit, and the mechanical display includes a window and a display surface visible through the window. At least one embodiment of the invention is based on the insight that prior mechanical displays require a great deal of space within the command device, and are also prone to failure. The problem of space-saving integration is solved by a display surface formed on the spring bar mounted on the actuation part, and the display surface, together with at least a part of the spring bar, is intended to make a partial rotary motion about a rotary axis during the actuation motion. In addition to the space-saving integration, a greater displacement of the display surface is also thus achieved. At least one embodiment of the invention further relates to an electromechanical operating device having a switch unit that can be switched by such an actuator.

10 Claims, 2 Drawing Sheets

ACTUATOR

PRIORITY STATEMENT

This application is the national phase under 35 U.S.C. §371 of PCT International Application No. PCT/EP2008/061511 which has an International filing date of Sep. 1, 2008, which designates the United States of America, and which claims priority on German patent application number DE 10 2007 046 999.5 filed Oct. 1, 2007, the entire contents of each of which are hereby incorporated herein by reference.

FIELD

At least one embodiment of the invention generally relates to an actuator. For example, it may relate to one which is provided to switch a switching unit and has a mechanical display, the mechanical display having a window and a display surface that is visible through the window. At least one embodiment of the invention also generally relates to an electromechanical command device having a switching unit that can be switched by such an actuator.

BACKGROUND

Electromechanical command devices are widely used to operate and control machines and plants. They come in various forms, e.g. as pushbuttons, knob-operated switches, key switches or emergency stop switches. Command devices are mounted on switchboards, operating panels, switchgear cabinet doors or housing covers. Manual actuation of the command devices causes changes to electric switching states, thereby producing the desired control effects. Command devices are equipped as standard with a mechanical display to display prevailing switching states, the mechanical display in some instances being equipped alternatively or additionally with an illuminable or illuminated unit.

The requirement for an integrated visual display, which is both a mechanical and/or electrical switching display, poses the problem of accommodating the necessary components, as the overall volume of the device can only vary within narrow limits, in particular due to a standard installation diameter (e.g. 22.5 mm). Until now, when it was not possible to integrate the display in the command device, an additional command point, for example with an indicator light, was generally attached. The additional space requirement, for example on a switchboard of the installation unit, and the necessary use of a separate display make this solution disadvantageous.

A mechanical display for emergency stop mushroom heads is known from previous solutions and converts a linear actuation movement to a movement of a display element. However the deflection of the movement of the display element is limited, as the space requirement of the display mechanism would otherwise be too great.

SUMMARY

At least one embodiment of the invention specifies an actuator with a space-saving, visual display.

In an actuator of at least one embodiment, the display surface is connected to a spring bar attached to the actuating part of the actuator and is provided, during an actuation movement of the actuating part, together with at least part of the spring bar to make a partial rotational movement about an axis of rotation, which is oriented essentially perpendicular to the actuation movement of the actuating part. At least one embodiment is also directed to an electromechanical command device, in particular an emergency stop switch, with a switching unit that can be switched by such an actuator.

In at least one embodiment, a display surface is moved behind a window of the command device, in particular of the actuator, in such a manner that at least one display surface moves into the window or out of it. Alternatively a number of display surfaces, e.g. two or more display surfaces, are also conceivable, being visible to the user through the window in different switching states.

The mechanical display of the command device, in particular of the emergency stop switch, has one or more windows, one or more display surfaces and one or more spring bars attached to the actuating part of the actuator. A spring bar is coupled, connected or even connected as a single piece to one display surface or a number of display surfaces. The spring bar and the display surface(s) provided together form an indicator. The spring bar on the one hand has the task of holding the display surface and being able to move the display surface in a defined manner behind or in the window due to its elastic characteristic and length.

The connection of the spring bar, mechanically or as a single piece, to the actuating part or one of its components means that the spring bar and its display surface, i.e. the indicator as a whole, also perform the actuation movement of the actuating part. The spring bar is also forced to change its position relative to the actuating part at least partially. This happens because the spring bar comes up against a fixed component, for example a fixed collar, and is subject to elastic stress.

The spring bar now also executes a partial rotational movement to move in the actuation direction, said rotational movement being about an axis of rotation, which is oriented perpendicular to the actuation direction. Finally an element of the actuation force, which is transmitted by way of the actuating part, is deflected by the non-moving (fixed) component such that the spring bar is subject to elastic stress and the display surface therefore moves.

The visual display is advantageously realized by way of a purely mechanical action principle, independently of a power supply. For the user this means that no additional wiring outlay is required. The display functions reliably, particularly as electrical fault sources, such as faulty incandescent lamps, are excluded.

During the actuation movement the spring bar is advantageously provided to be stressed elastically. Of advantage here is a spring bar, which is formed in the manner of a leaf spring and has a small cross section in relation to its length, in particular a wire-type body, which can be easily integrated in the interior of the actuator and keeps friction due to low deformation forces at a low level.

In one advantageous embodiment the spring bar is provided to come into contact with the actuating part during the actuation movement. Such contact between the spring bar and the actuating part can optionally define an axis of rotation for the rotational movement of the display surface. It is also possible to define a radius for the rotational movement and therefore a deflection of the display surface by selecting the contact point.

The rotational movement of the display surface can advantageously be triggered by a fixed component, which forces the spring bar into a different position relative to the actuating part during actuation. In some instances the forced movement of the spring bar is assisted by means of lugs and/or bevels. This applies in particular to the rotational movement.

In one advantageous embodiment the lugs and/or beads are provided to assist local contact between the spring bar and the fixed component. Beads here are spot-type or linear elevations or granularities in the spring bar. Local contact significantly reduces the friction that occurs at the point of contact between the spring bar and the fixed component. This facilitates actuation of the actuator, reduces actuation noise and extends service life.

In one advantageous embodiment the spring bar is very long, so that even a small elastic stress in it results in a major deflection, i.e. in large deflection angles, in the manner of a lever effect. This allows large display surfaces to be used, which allow the state to be displayed to be visualized more clearly.

Further advantageous embodiments and developments of the invention are specified in the description of the figures and the subclaims.

BRIEF DESCRIPTION OF THE DRAWINGS

The invention is described and explained in more detail below with reference to the example embodiments illustrated in the figures, in which.

DETAILED DESCRIPTION OF THE EXAMPLE EMBODIMENTS

Figure 1:
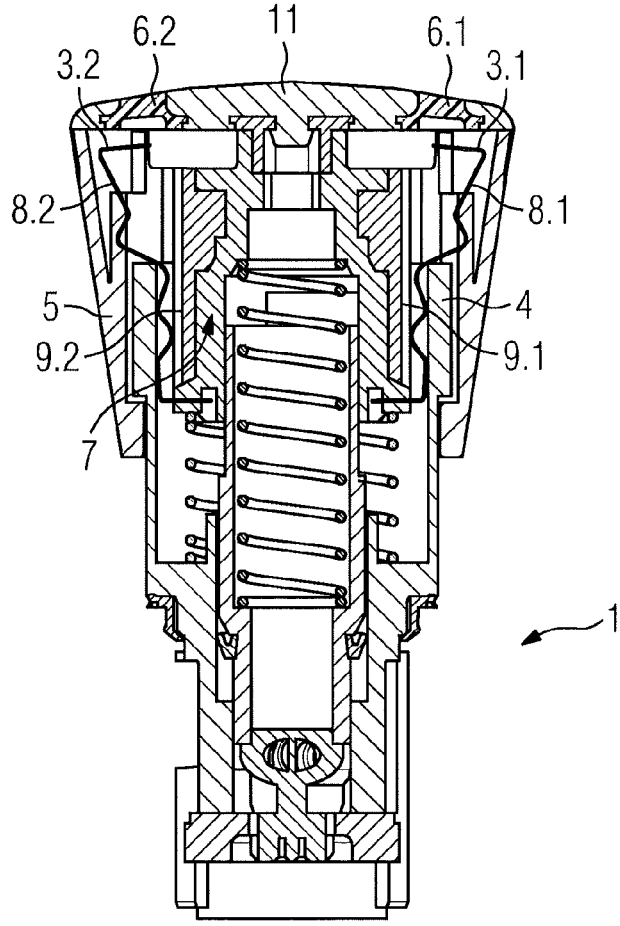
FIG. 1 shows a sectional view of an actuator of an emergency stop switch in the non-actuated state with two mechanical displays.

FIG. 1 shows a sectional view of an actuator 1 of an emergency stop switch in the non-actuated state with two mechanical displays, which are visible to a user through two windows 6.1, 6.2.

The two windows 6.1, 6.2 are accommodated in the mushroom head, formed from the mushroom cover 11 and mushroom skirt 5, of the actuator 1 and are formed from transparent plastic. Generally a window does not necessarily have to be formed from a transparent material but may simply include an in some instances correspondingly formed hole. The number of visual signal displays (displays) within the mushroom cover 11 or the actuator 1 can also vary.

The emergency stop switch (not shown in its entirety) is in the non-actuated state, in which the display surfaces 3.1 and 3.2 are visible to the user through the windows 6.1, 6.2.

The windows 6.1, 6.2 are advantageously realized in the manner of insertion elements, around which the plastic of the mushroom cover 11 is injected. There is therefore no need for snap-on hooks or similar geometries, which could restrict the visibility of the display surfaces 3.1, 3.2. Production as a multi-component injection molding is also possible.

Associated with each of the display mechanisms of the two mechanical, visual displays are two indicators, each formed from a spring bar 8.1. 8.2 and the associated display surface 3.1, 3.2. Also associated with the display mechanism is the collar 4, which being a fixed component of the actuator 1 does not take part in the actuation movement and is provided for the elastic deformation of the spring bar 8.1, 8.2, which can be moved toward the collar 4.

Figure 2:
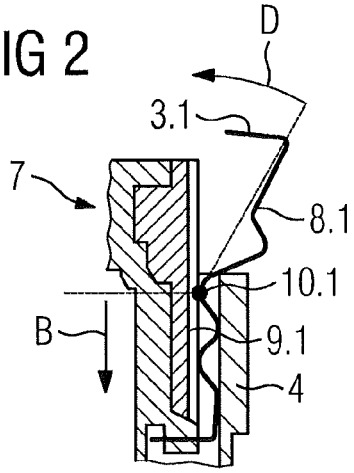
FIG. 2 shows a sectional view of the display mechanism of the actuator in FIG. 1 in the non-actuated state.

FIG. 2 shows a sectional view of the right-hand display mechanism of the actuator 1 in FIG. 1 in the non-actuated state. The spring bar 8.1 is attached to the actuating part 7, so that it is able to follow the linear actuation movement B. The spring bar 8.1 is in an elastically unstressed state, with the spring bar 8.1 being disposed above the fixed collar 4 and in contact with the mushroom skirt 5. The collar 4 is a fixed component and is fixed for example to a front plate or operating panel.

During actuation of the actuator 1 the spring bar 8.1 and the display surface 3.1 are moved in the actuation direction B along with the mushroom cover 11 and the mushroom skirt 5. At the same time the presence of the collar 4 causes the upper part of the spring bar 8.1 to rotate about the axis of rotation 10.1, to move into position between the collar 4 and the contact point 9.1. The upper part of the spring bar 8.1 executes a partial rotational movement D, with the result that the display surface 3.1 moves closer to the center of the actuator 1.

Such a mechanism functions correspondingly even if the actuation movement B is not a linear movement (as shown in FIG. 2) but is also functional if the actuation movement is a rotational movement. To this end the actuator or actuating part can have an at least partially round shape, as can the fixed component, to ensure optimum assistance for this rotational movement.

It should be noted that an embodiment of the inventive display mechanism does not necessarily have to be combined with an emergency stop switch but can be used with all command devices that operate on the basis of switching elements.

The display surface 3.1 itself advantageously indicates a single state (emergency stop not actuated) in each instance. In a second state (emergency stop actuated) the display surface 3.1 is not visible in the window 6.1. The user sees through the window 6.1 into the interior of the command device, giving the impression of a black display color. To complement this the display surface 3.1 could have a white or otherwise light color. This also applies to the two display surfaces 3.1, 3.2 in FIG. 1. A reverse color change is likewise possible, if a fixed light display surface is assumed to be present behind the windows 6.1, 6.2 and is revealed by the display surface 3.1, 3.2 on actuation.

The details relating to FIG. 2 also apply correspondingly to the left-hand display mechanism of the emergency stop switch in FIG. 1.

Figure 3:
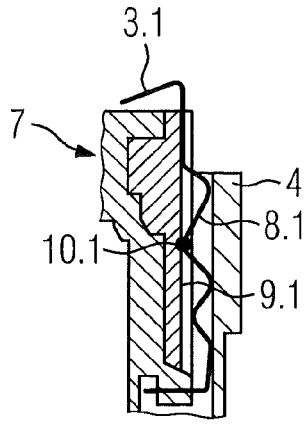
FIG. 3 shows a sectional view of the display mechanism of the actuator in FIG. 1 in the actuated state and FIG. 4 shows a sectional view of the actuator of the emergency stop switch in FIG. 1 in the actuated state.

FIG. 3 shows a sectional view of the right-hand display mechanism of the actuator in FIG. 1 in the actuated state.

In the actuated state the spring bar 8.1 is essentially between the fixed collar 4 and the contact point 9.1 of the actuating part 7. A rotational movement D causes the display surface 3.1 to assume a different angle to the actuating part 7 and also to the window 6.1. The actuating part 7 has a surface 9.1, which functions as the contact point for the spring bar 8.1 and is also referred to below as the contact point 9.1.

The spring bar 8.1 rests against the contact point 9.1 at point 10.1 among others, point 10.1 being the axis of rotation 10.1 for the inventive partial rotational movement D, which projects in a perpendicular manner out of the plane of the drawing. The axis of rotation can be located at different points. The further down on the spring bar 8.1 it is, the larger the angle the display surface 3.1 passes through during actuation. If smaller angles are desired, it is possible to define a position between the display surface 3.1 and the securing point by contact with the actuating part 7 by shaping or bending the spring bar 8.1 accordingly.

It is of course possible to attach two or more display segments or a number of signal colors to the display surface 3.1, to indicate different switching states.

The spring bars 8.1, 8.2 can in some instances be pushed inward by lugs attached thereto, for example over bevels in the collar. Beads can optionally be attached to these lugs, to allow local rather than linear contact between the spring bars

8.1, 8.2 and the collar 4. It is therefore possible to keep friction losses low by shaping the beads accordingly. This measure can also reduce the noise produced during actuation or unlocking.

The reduction of friction also means that the predetermined actuation path of the emergency stop switch, generally of 4 mm, can convert a displacement of the display surface 3.1 in the mushroom head more efficiently. This produces larger displacement paths and therefore also results in a larger display surface 3.1 and/or a larger window 6.1.

The details relating to FIG. 3 also apply correspondingly to the left-hand display mechanism of the emergency stop switch in FIG. 1.

Figure 4:
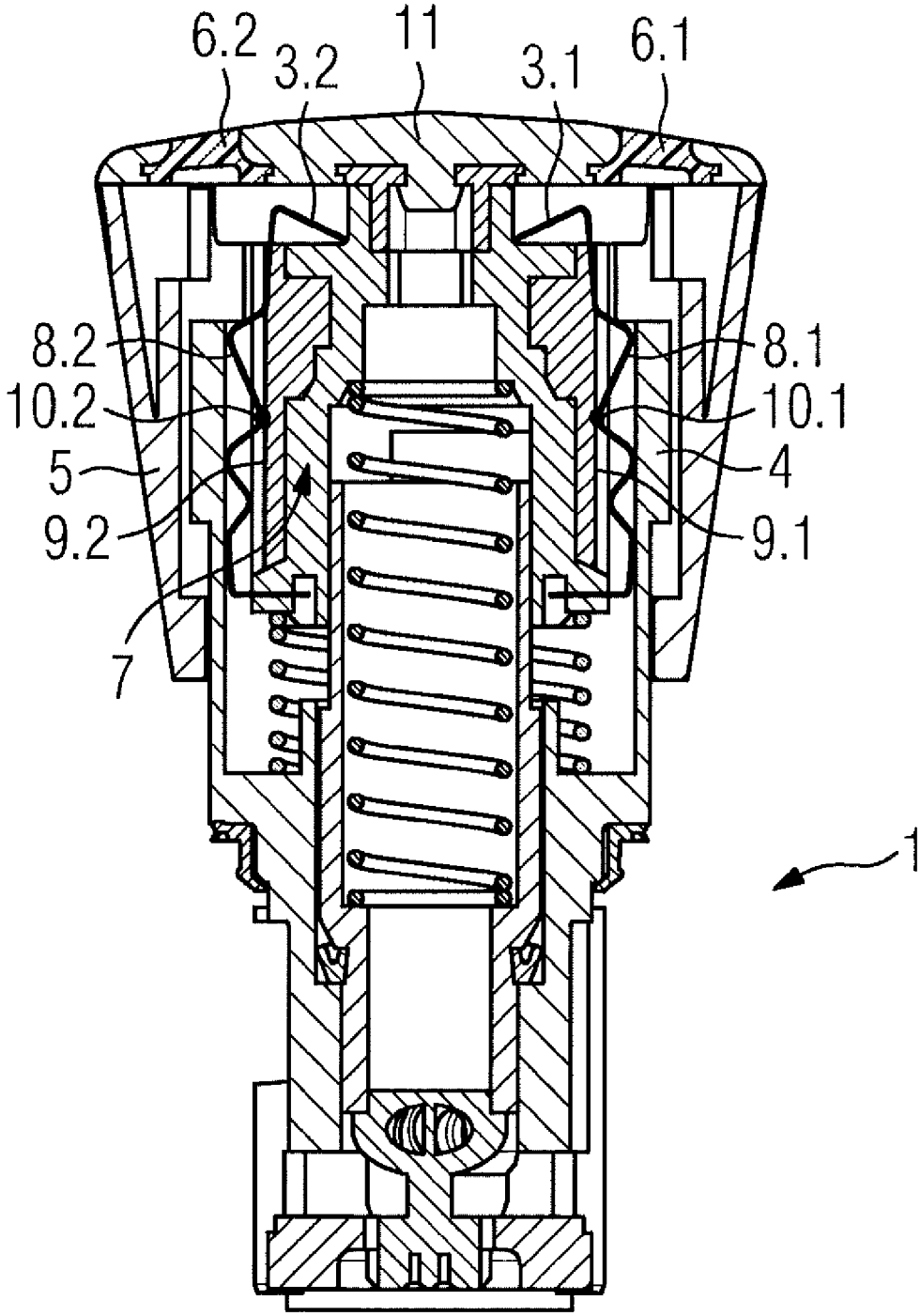

FIG. 4 shows a sectional view of the actuator 1 of the emergency stop switch in FIG. 1 in the actuated state. In the actuated state the user sees through the window 6.1, 6.2 into the interior of the emergency stop switch, with a resulting impression of the color "black". The display surfaces 3.1, 3.2 are below non-transparent parts of the mushroom cover 11. The rotational movement D of the spring bars 8.1, 8.2, which are now subject to maximum elastic stress, during actuation causes the display surfaces 3.1, 3.2 to assume a different angle to the actuating part 7 and also to the windows 6.1, 6.2 from the angle in the non-actuated state.

To summarize, an embodiment of the invention relates to an actuator having a mechanical display, the actuator being provided to switch a switching unit and its mechanical display having a window and a display surface that is visible through the window. The invention is based on the knowledge that former mechanical displays take up a great deal of space within the command device and are also prone to error. The problem of space-saving integration is resolved by a display surface which is connected to a spring bar attached to the actuating part and the display surface is provided, during the actuation movement, together with at least part of the spring bar to make a partial rotational movement about an axis of rotation. As well as allowing space-saving integration, this also allows a larger displacement path of the display surface to be achieved. An embodiment of the invention also relates to an electromechanical command device having a switching unit that can be switched by such an actuator.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An actuator, provided to switch a switching unit, comprising:

an actuating part; and a mechanical display including a window and a display surface that is visible through the window, the display surface being connected to a spring bar attached to the actuating part, the display surface being provided, during an actuation movement of the actuating part, together with at least part of the spring bar to make a partial rotational movement about an axis of rotation, the axis of rotation being oriented essentially perpendicular to the actuation movement of the actuating part, the spring bar being stressed elastically during the actuation movement of the actuating part.

2. The actuator as claimed in claim 1, wherein a fixed component of the actuator is provided at least partially to stress the spring bar elastically.

3. The actuator as claimed in claim 2, wherein the fixed component is provided to assist the rotational movement by way of at least one of lugs and bevels.

4. The actuator as claimed in claim 3, wherein the lugs include beads, provided to assist local contact between the spring bar and the fixed component.

5. The actuator as claimed in claim 1, wherein the spring bar is provided to come into contact with the actuating part during the actuation movement of the actuating part.

6. The actuator as claimed in claim 1, wherein the spring bar includes at least one of a spring-like and lever-type form.

7. A command device, comprising a switching unit that can be switched by way of the actuator as claimed in claim 1.

8. The actuator as claimed in claim 2, wherein the fixed component is a collar of the actuator.

9. The actuator as claimed in claim 5, wherein the spring bar is provided to come into contact with the actuating part at a contact point during the actuation movement of the actuating part.

10. The command device of claim 7, wherein the command device is an emergency stop switch.

* * * * *